US005782197A

United States Patent [19]

Pollack

[11] Patent Number: 5,782,197

[45] Date of Patent: Jul. 21, 1998

[54] OFFSHORE TURRET LOWER BEARING

[75] Inventor: Jack Pollack, Calabasas Hills, Calif.

[73] Assignee: Imodco, Inc., Calabasas Hills, Calif.

[21] Appl. No.: 763,718

[22] Filed: Dec. 13, 1996

[51] Int. Cl.[6] ..... B63B 21/00

[52] U.S. Cl. ..... 114/230

[58] Field of Search ..... 114/230, 293; 441/3, 4, 5; 384/193, 202, 215, 220, 221, 226, 247, 447, 456; 166/354, 355

[56] References Cited

U.S. PATENT DOCUMENTS

| | | | |
|---|---|---|---|
| 4,305,341 | 12/1981 | Stafford | 114/230 |
| 4,665,855 | 5/1987 | Delamare | 114/230 |
| 4,955,310 | 9/1990 | Pollack | 114/230 |
| 5,316,509 | 5/1994 | Boatman et al. | 114/230 |
| 5,515,804 | 5/1996 | Pollack | 114/230 |
| 5,517,937 | 5/1996 | Lunde | 114/230 |

FOREIGN PATENT DOCUMENTS

| | | | |
|---|---|---|---|
| 61-275086 | 12/1986 | Japan | 114/293 |

*Primary Examiner*—Sherman Basinger
*Attorney, Agent, or Firm*—Freilich Hornbaker Rosen

[57] ABSTRACT

A bearing assembly that mounts the lower portion of a rotatable large (at least 4 meters diameter) turret in a moonpool near the center of a vessel, avoids damage resulting from turret and/or vessel deformation in heavy seas, while facilitating initial alignment. The turret (10) holds a substantially continuous bearing ring (44) while a hull part (42) holds a plurality of circumferentially-spaced segment structures (46) that have segment bearings (50) engaged with the bearing ring. Each segment structure includes a base (56), and an elastic body (60) that supports the bearing segment while allowing it to move radially or tilt. A deflection limiter (80) can limit deformation of the elastic body. Each segment structure can include an adjustment device (62) that adjusts the position of the bearing segment during setup. Each segment structure can include a spherical elastic body (246) which has circumferentially-spaced opposite sides (272, 274) that face a point (270) lying adjacent to the interface (241) of the bearing segment (240) with the continuous bearing ring (242).

19 Claims, 6 Drawing Sheets

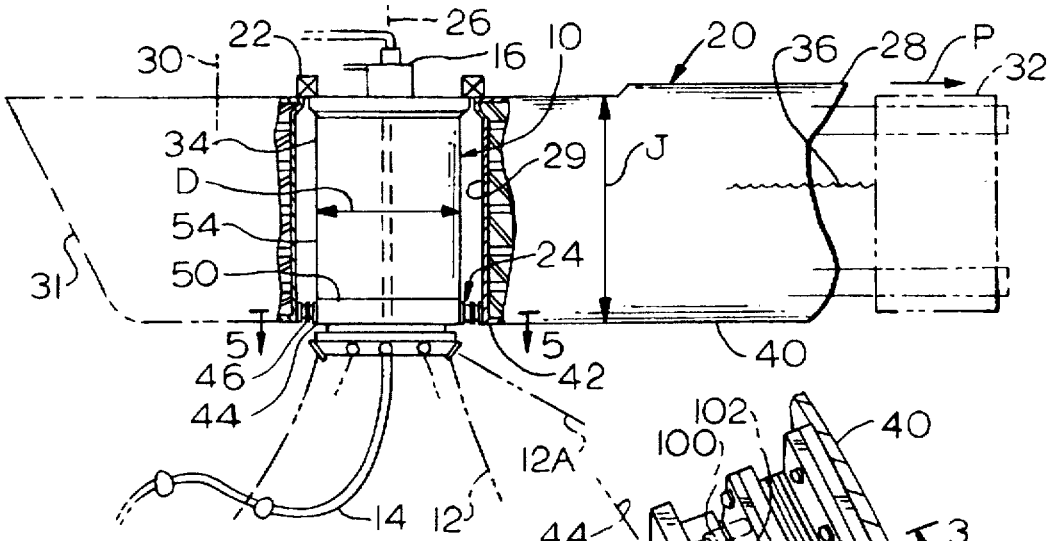
FIG. 1
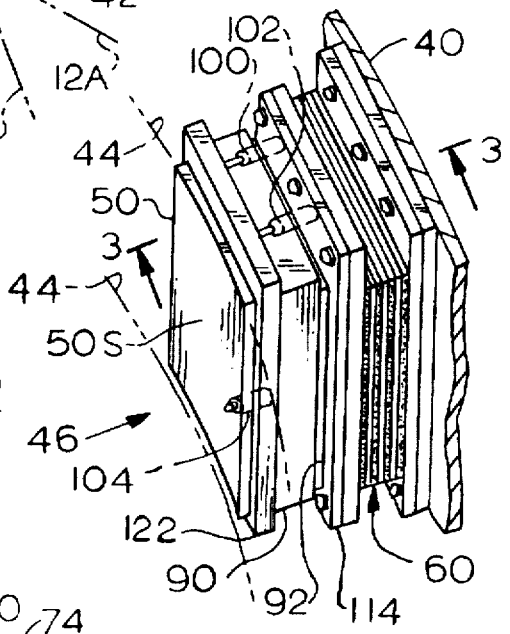
FIG. 2
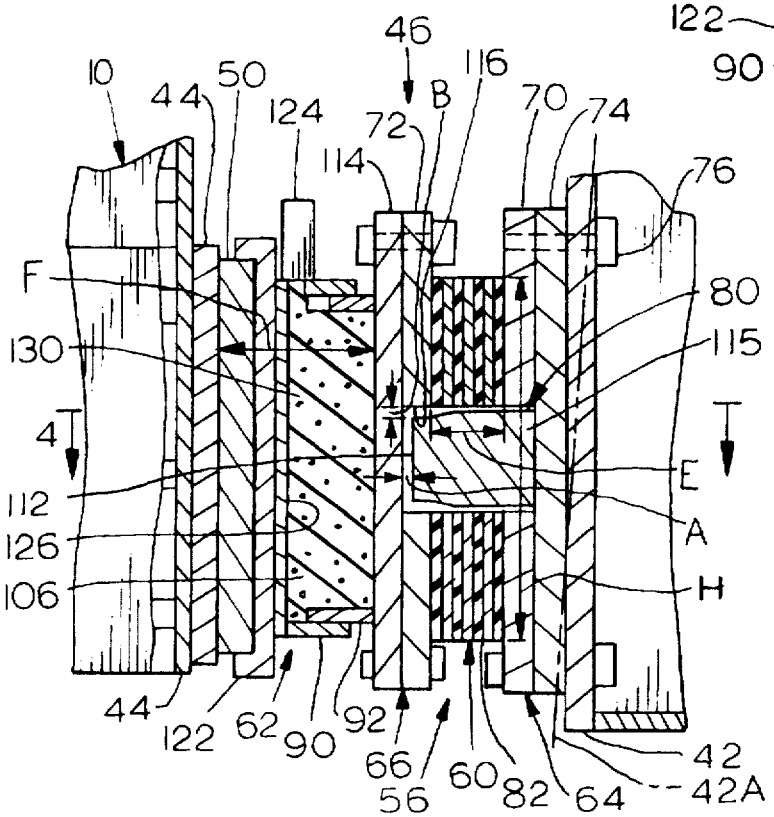
FIG. 3
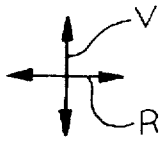

FIG. 4
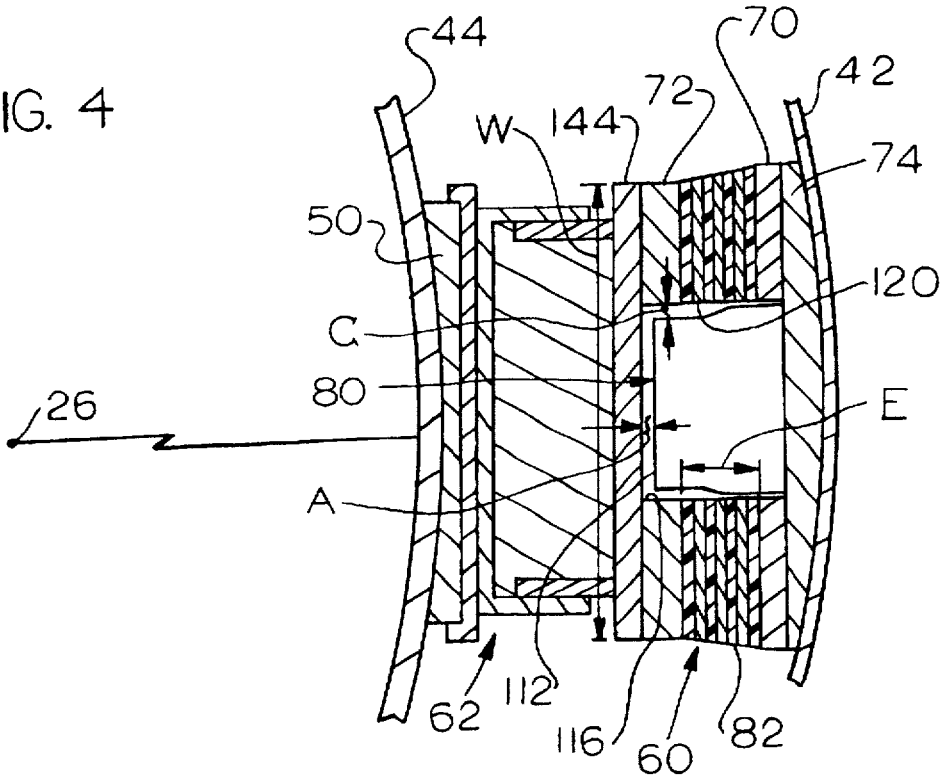
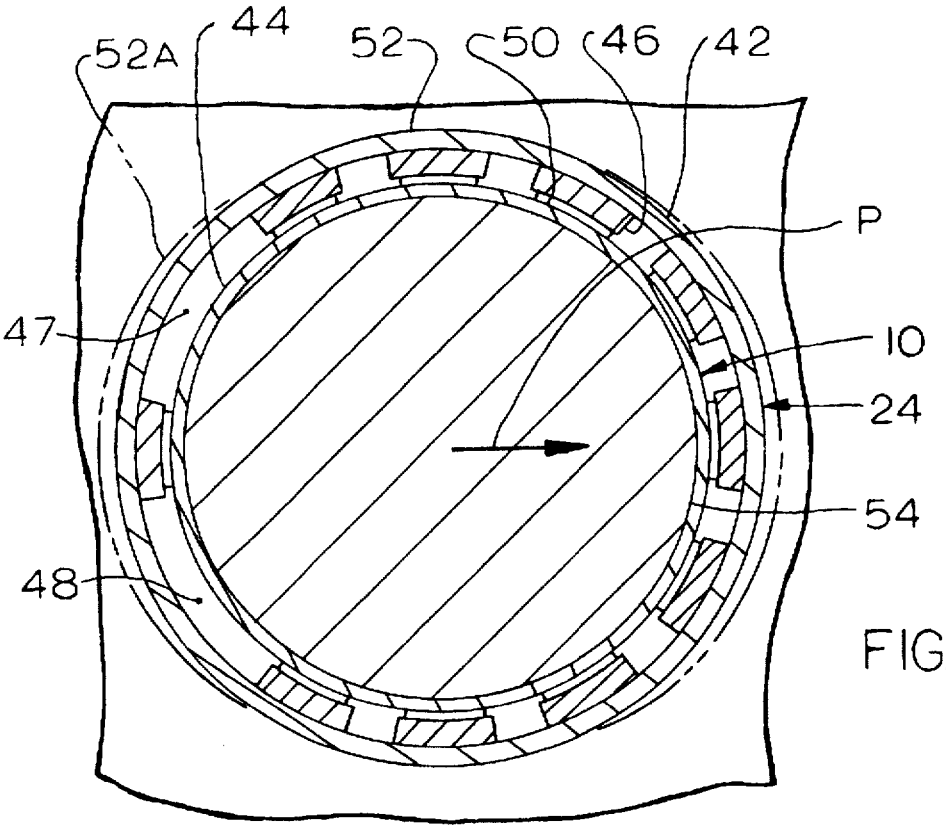
FIG. 5

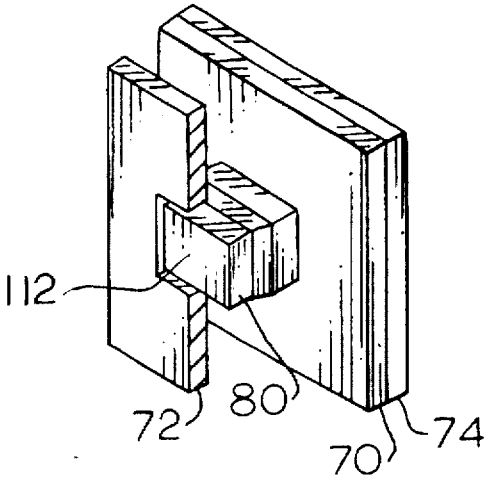
FIG. 6
FIG. 7
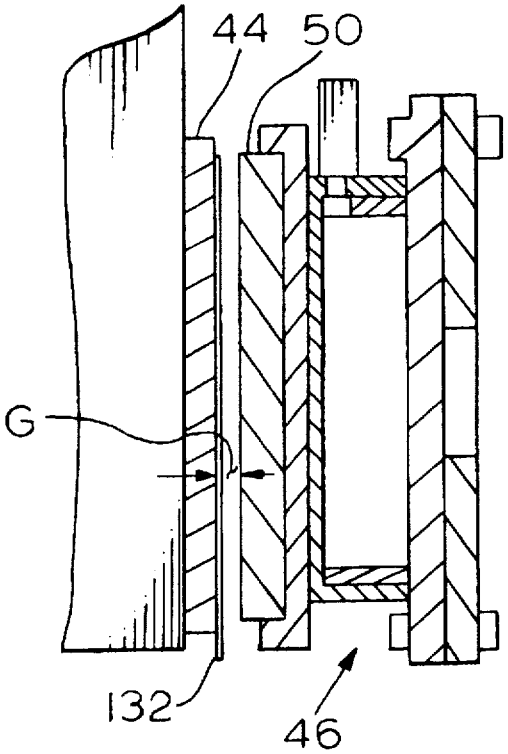
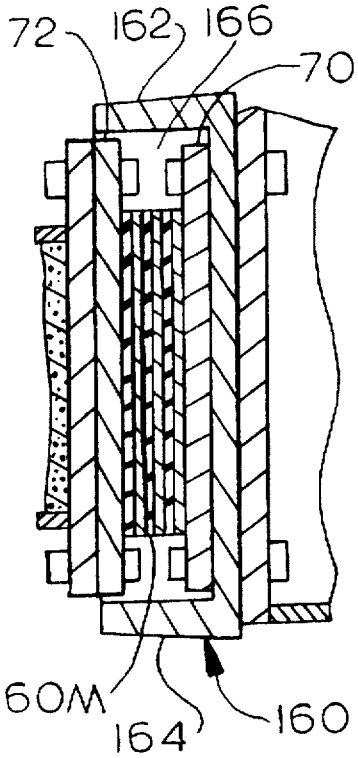
FIG. 8
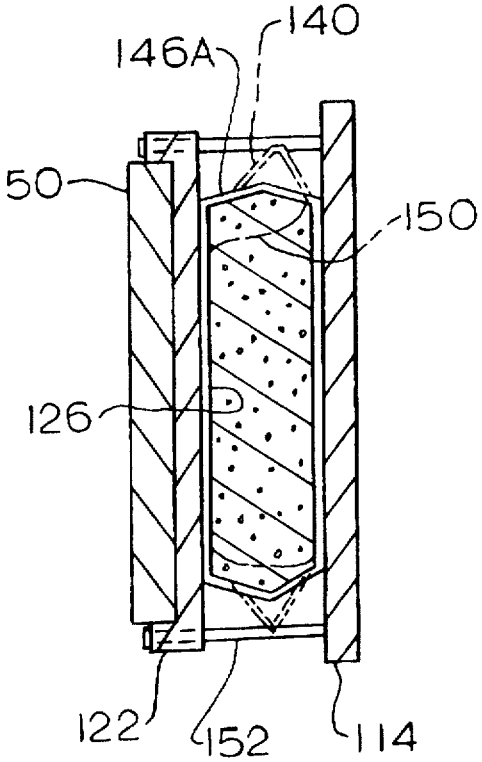
FIG. 9

210

202
212
204
206
K
F
208
208A
200
G
11
11
241

OFFSHORE TURRET LOWER BEARING

BACKGROUND INVENTION

Turrets are commonly used on large vessels employed for production and/or storage of hydrocarbons from subsea reservoirs. Such turrets, which typically have a diameter of two to twenty meters, must be designed to transfer large mooring loads while allowing the vessel to rotate about the turret. The bearing system for mounting the turret on the vessel hull, can include an upper bearing which supports the weight of the turret and prevents sideward movement of the upper end, and a lower bearing which prevents sideward movement of the lower turret portion and which takes most of the horizontal mooring loads. The turrets are constructed to be substantially rigid, so the upper and lower bearings previously had to be accurately aligned.

Where the turret is of small relative diameter (e.g. under 2 meters diameter for a 20 meters tall turret), the turret may be tilted when chains, hoses, etc. are hung from the turret during set up in the field. Thus, even if the upper and lower turret bearings are precisely aligned in a ship yard, they are likely to become misaligned in the field when heavy structures are attached. Such misalignment can cause rapid bearing wear. Applicant's U.S. Pat. Nos. 4,955,310 and 5,515,803 describe the use of elastomeric bodies that can deform to allow turret tilt. Where the turret is of large relative diameter (over 4 meters diameter for a 20 meters tall turret), the large diameter bearings avoid substantial turret tilt when structures are attached in the field. As a result elastomeric bodies are not required to enable tilt of large turrets.

Applicant finds that when a large diameter turret lies in a moonpool near the middle of the vessel (away from the bow or stern), another phenomenon occurs in heavy seas. This phenomenon is that distortion of the middle of the hull (e.g. from a circle to an oval) relative to the turret can cause large forces on the turret. Previously, to avoid damage, the turret and hull portions around the turret had to be rigidized, at great expense. If the effect of middle hull distortion could be minimized, then the cost of a vessel with a large diameter turret near the hull middle, could be reduced.

One type of lower bearing includes a bearing ring mounted on the turret and a plurality of segment structures mounted on the hull and carrying segment bearings that engage the bearing ring. During installation of each bearing structure, it must be positioned so its segment bearing lies substantially facewise against the bearing ring to prevent more than minimal horizontal movement between them. It would be desirable if each segment structure could be readily installed so its segment bearing lay facewise substantially against the bearing ring without pressing hard against it (which could cause excessive wear).

SUMMARY OF THE INVENTION

In accordance with one embodiment of the present invention, a turretvessel bearing assembly is provided, that is especially useful for large diameter turrets lying in a vessel hull moonpool. The bearing assembly is of the type that has a plurality of segment structures spaced about the bearing axis and having segment bearings that bear against a continuous bearing ring at an interface, where each segment structure permits considerable but limited deflection of the segment bearing, in a relatively simple construction and wherein each segment structure facilitates its initial installation. Each segment structure includes a base with radially spaced base elements and an elastic body lying between them, to permit one of the base elements that supports a segment bearing to be deflected by deflection of the elastic body as in heavy seas.

A deflection limiter extends between the base elements to limit their relative deflection so as to prevent damage to a relatively simple elastomeric body. Each segment structure includes an adjustment device with radially-spaced adjustment parts that initially can move apart, and with a quantity of hardenable material such as grout between the parts to fix their final positions.

The elastic body can have opposite sides facing toward a center location that lies close to the bearing face, to avoid "digging in" of the bearing segment when there is high friction at the interface.

The novel features of the invention are set forth with particularity in the appended claims. The invention will be best understood from the following description when read in conjunction with the accompanying drawings.

BRIEF DESCRIPTION OF THE DRAWINGS

FIG. 1 is a side elevation view of an offshore terminal of the present invention.

FIG. 2 is an isometric view of a segment structure of the lower bearing of FIG. 1.

FIG. 3 is a view taken on line 3—3 of FIG. 2.

FIG. 4 is a view taken on line 4—4 of FIG. 3.

FIG. 5 is a view taken on line 5—5 of FIG. 1.

FIG. 6 is a partial isometric view of the segment structure of FIG. 2.

FIG. 7 is a partial sectional view of the segment structure of FIG. 3, prior to movement of the bearing segment against the bearing ring.

FIG. 8 is a partial sectional view of a segment structure with a body and deflection limiter of another embodiment of the invention.

FIG. 9 is a partial sectional view of a segment structure with an adjustment device of another embodiment of the invention.

DESCRIPTION OF THE PREFERRED EMBODIMENTS

Figure 10:
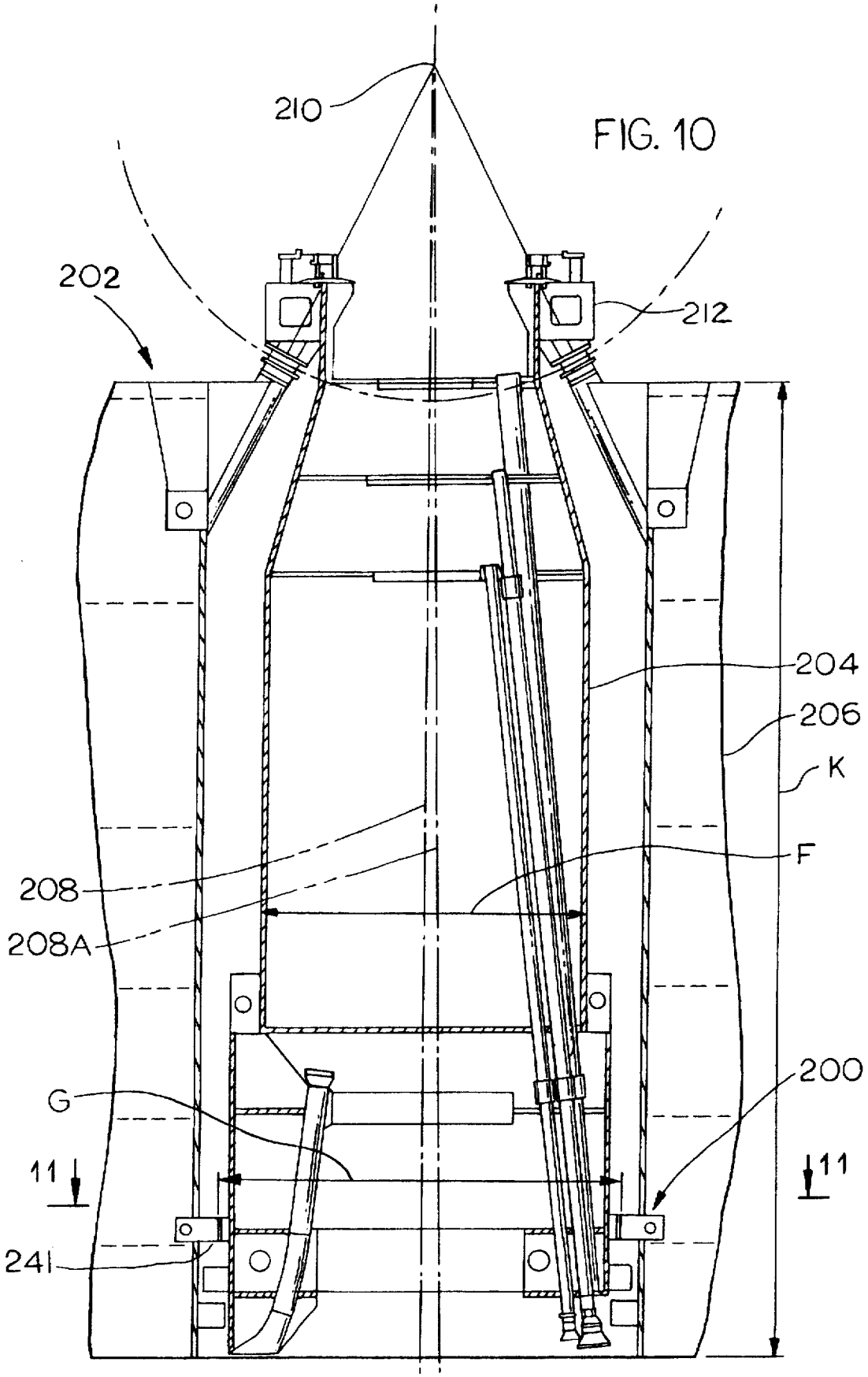
FIG. 10 is a sectional side view of an offshore terminal of another embodiment of the invention.

FIG. 1 illustrates a transfer structure with a turret 10 that is anchored to the seafloor, as through catenary chains 12, and which is coupled to a fluidcarrying conduit 14 that may extend down to the seafloor, as to carry hydrocarbons from a subsea well and through a fluid swivel 16 to oil storage tanks on a vessel 20. Upper and lower bearing assemblies 22, 24 allow the vessel 20 to weathervane, or rotate about the turret axis 26, as a result of changing winds and currents. The turret is located in a "moon pool" 29 in the vessel hull 40, between the bow 28 (which faces in a forward direction P) and the stern 31 and is shown lying near a midship location 30. The moonpool 29 usually lies in a middle portion of the vessel, where the distance between each vessel end such as the bow 28 and the turret axis 26 is more than the average height J of the vessel hull. In some cases, especially for smaller turrets, the turret can even be placed outboard of the vessel as indicated at 32. Turrets of this type commonly have a diameter D of up to 20 meters and lie in vessels having a hull height J of about 20 meters or more (and a hull length of at least 100 meters. For large diameter turrets (4 to 20 meters diameter) lying in the middle portion of the vessel, deformation resulting from heavy seas, of the turret and/or vessel hull immediately around the turret, is an important factor. Such deformation may include deformation of the turret or of the opening in the vessel hull, changing from a vertical cylindrical configuration to an oval configuration, or in racking (twisting) of the hull or turret. For small diameter turrets, which are those less than two meters diameter, the major deformations are generally only tilt of the lower bearing with respect to the upper one particularly when heavy chains are attached. Similarly, for a turret placed outboard of the vessel as at 32, the turret and surrounding structure is largely isolated from hull distortion, and the major deformations are in tilt particularly when heavy chains are attached. It is only for a large diameter turret lying in a moonpool in the middle portion of the hull, that deformation (rather than tilt) is a major problem.

The upper bearing assembly 22 is an axial and radial bearing, that supports the weight of the turret and load thereon while preventing radial movement of the turret upper portion 34 with respect to the hull. The upper bearing assembly 22 lies above the sea surface 36. The lower bearing assembly 24 prevents only radial movement, and generally lies below the sea surface. The mooring structure such as chains 12 is usually configured so in heavy seas most mooring load, or horizontal load, is taken by the lower bearing arrangement 24. In heavy seas the chains 12 extend closer to the horizontal and are under high tension, as at 12A. In heavy seas, the turret 10 and/or vessel hull 40 may be distorted, as where the outside of the turret 10 or the inside of a hull part 42 that surrounds the vessel is distorted into an oval cross-sectional shape, or bent about horizontal axes, or otherwise deformed. The vessel acts like a long box beam, and large stress and distortions occur, for example, when the middle of the vessel rides on the crest of a wave.

As shown in FIG. 5, the lower bearing assembly 24 includes a substantially continuous bearing ring 44 mounted on the turret 10, and a group of e.g. ten segment structures 46 that each includes a bearing segment 50. Each segment structure 46 is mounted on the hull part 42 that surrounds the turret. The segment structures 46 are circumferentially spaced about the turret axis 26. Two gaps are present at 47, 48, instead of placing bearing segments there. This is because the greatest horizontal mooring load components are applied in direction P which is away from the stern. It is possible to instead mount the bearing ring on the hull and the segment structures on the turret, but this is generally undesirable because of space and machining considerations.

FIG. 5 shows that in heavy seas, a nominally circular surface 52 of the hull can be formed to the slightly oval configuration shown at 52A (the showing is exaggerated). A similar deformation can occur for the lower turret part 54 and the bearing ring 44. As shown in FIG. 3 the hull part 42 can twist, as where it deforms to the position 42A. Each of the segment structures 46 is constructed to permit the corresponding bearing segment 50 to move and tilt to accommodate slight deformations of the hull and turret. As a result, very large loads do not have to be transferred through locally stiff areas of the turret or hull, which could damage the bearing, turret, and/or hull in adverse weather conditions such as heavy seas.

As shown in FIG. 3, each segment structure 46 includes a base 56 that is mounted on the hull part 42, with the base including an elastic body 60. Each segment structure also includes an adjustment device 62 that supports a bearing segment 50 on the base 56. The adjustment device 62 shown is a mechanism that aids in initial installation of a segment structure, as will be described below.

The body 60 is formed of plates of elastomeric material such as rubber, spaced by plates of rigid material such as steel, and is held between a pair of elements 64, 66 that include body plates 70, 72. The element 64 also includes a limiter plate 74 that lies between the body plate 70 and the hull portion 42, with several bolt-and-nut fasteners 76 fastening the element 64 to the hull. The base also includes a deformation limiter 80 that limits deformation of the elastomeric body 60.

The segment structure 46 is set up to hold the bearing segment 50 so it presses facewise with only a small force against the bearing ring 44, or is only slightly spaced from the bearing ring, in the quiescent position of the system (i.e. in calm weather). However, when the vessel is subjected to large waves or other large forces in heavy weather, resulting in deformation of the hull part 42 with respect to the turret, the elastomeric material 82 of the body will elastically deform to allow a location along the bearing ring 44 to move closer to an opposite location on the hull part 42. In one example, when the hull part 42 deforms to the position 42A, so there is relative tilt about a horizontal axis, the lower portion of the body 60 can undergo compression. In other cases, the entire hull location can move towards the opposite bearing ring location, so that the entire elastic body 60 may be compressed. The elastomeric body 60 can undergo considerable decrease in radial length (relative to the turret axis) while causing the segment structure 46 to press with only a moderately increased force against the hull part 42 and the bearing ring 44. Without the elastomeric body 60, a given reduction in distance between the bearing ring and hull part would result in a much greater force on them, which could damage them. Of course, to prevent such damage without the elastomeric body, the turret and hull part would have to be constructed with greater stiffness to minimize such deflection, which would add considerable cost to the system.

The deformation limiter 80 limits deformation of the elastomeric body 60 in directions perpendicular to the radial direction R and along the radial direction, and therefore limits relative deflection of the body plates 70, 72. The limiter has a radially outer end 115 that is fixed with respect to the radially outer element 64. The limiter has a radially inner end 112 that can abut an adjustment plate 114 to prevent excessive radial misalignment movement (in directions R) of the bearing ring, which could damage the upper bearing. In the initial position, the inner end 112 of the limiter is spaced a distance A from the plate 114, and therefore prevents radial movement of more than the distance A.

FIG. 3 also shows that the deformation limiter 80 limits vertical deformation of the body 60 in directions V by limiting relative vertical movement of the two body plates 70, 72. Initially, the end 112 of the limiter is spaced a distance B from upper and lower walls of a hole 116 in the body plate 72. If the relative vertical deformation of the turret and hull exceeds the distance B, then the limiter will prevent additional deformation (unless a very large deforming force is applied). The limitation of relative vertical movement to the distance B protects the body 60 from shear damage that could occur if the distance B is considerably exceeded.

FIG. 4 shows that the limiter 80 also limits relative circumferential movement (with respect to the turret axis 26) of plate 72 relative to plate 70. Initially, the end 112 of the limiter is spaced by the distance C from circumferentially spaced walls of the plate hole 116. Relative circumferential movement is limited, because more than a limited circumferential movement can result in shear damage to the elastomeric material 82 of the body 60. Large relative circumferential movement would occur in the event that there is high friction between the bearing segment 50 and the bearing ring 44. It is noted that such circumferential movement gives rise to the greatest possibility of damage to the elastic body.

In a system that applicant has designed, wherein the turret has a diameter D (FIG. 1) of ten meters, the elastic body 60 has a length E (FIG. 3) of about 0.2 meters, and other dimensions relative thereto approximately as illustrated. The deformation limiter 80 (FIG. 3) allows the plate 72 and the bearing segment 50 to move vertically up or down by a distance B of 50 mm (millimeters). The deformation limiter permits the plate 72 to move circumferentially by a distance C (FIG. 4) of 50 mm. The end 112 of the deformation limiter permits radial movement A of 10 mm.

The presence of a largely radially-extending passage 120 (FIG. 4) within the middle of the body, to accommodate the limiter 80, allows a single limiter to be used which is of considerable horizontal width and vertical height, to withstand large forces that limit shear of the elastomeric body. The arrangement also enables the end 112 of the limiter to limit body deflection in directions perpendicular to the radial directions (i.e. vertically and circumferentially) as well as radially.

The ten segment structures 46 of FIG. 5 can be installed on the hull part 42 once the alignment of the upper bearing assembly has been assured with respect to the lower bearing assembly. Each of the segment structures 46 must be installed so its corresponding bearing segment 50 lies lightly against the bearing ring 44 or is only slightly spaced from the bearing ring. Any spacing of a bearing segment 50 from the bearing ring must be small, preferably less than 1 mm, so moderate to large mooring loads which apply a force in one horizontal direction to the bottom of the turret, are supported by a plurality of bearing segments. The distance between any bearing segment 50 and the bearing ring 44 should be much less than 1 centimeter, so the bearing segment can help support the bottom of the turret (with other bearing segments on the same side of the turret) when a very large horizontal force is applied to the bottom of the turret in heavy seas.

The adjustment device 62 (FIG. 3) that connects each base 56 to a corresponding bearing segment 50, is constructed so the distance F between them can be increased. Specifically, the distance F can be increased after mounting the segment structure 46 on the hull part 42. The adjustment device 62 includes first and second piston-like adjustment parts 90, 92, with part 90 functioning as a cylinder or tube and part 92 acting as a piston. The first part 90 is coupled to the bearing segment 50 through a bearing segment retainer 122, and the second part 92 is coupled through the base 56 to the hull part 42. An inlet 124 leads from the outside to the space or volume 126 between the telescoping adjustment parts. A fixing liquid can be pumped through the inlet 124 to fill the volume 126.

When the segment structure is initially mounted on the hull, there is a space G (FIG. 7) of about 25 mm between the bearing segment 50 and the bearing ring 44. A removable shim 132 is shown, having a thickness on the order of magnitude of 1 mm. During installation of the segment structure 46, applicant attaches at least three actuators, shown in FIG. 2 at 100, 102, 104 so they extend between the retainer 122 and the adjustment mechanism plate 114. The actuators are energized to move the retainer 122 and the bearing segment 50 thereon radially inward until the bearing segment 50 lies substantially facewise against the bearing ring 44. The adjustment parts 90, 92 preferably can tilt slightly relative to one another to press the entire surface of the bearing segment facewise against the bearing ring. Either during or immediately after this, a fixing liquid such as grout (which is liquid at room temperature) is pumped in through the inlet 124 (FIG. 3) to fill the volume 126. The actuators 100–104 can be removed (preferably after the grout has hardened, but possibly before then).

When the grout hardens, the bearing segment 52 will lie facewise against the cylindrical bearing ring 44. All portions of the bearing segment surface 50S press substantially equally or are slightly spaced equally from the bearing ring 44. The temporarily-installed shim can be placed between the bearing segment 50 and the bearing ring, to assure that there will be very low friction between them, or a very small gap between them, in the quiescent position of the system. Such a shim is desirable, as the pressure of the liquid grout can cause the elastic body 60 to be compressed, and it is desirable to release all or part of this compression when the grout has hardened. After the grout 130 has hardened, the actuators 100–103 and shims are removed, and the installation is complete.

A variety of adjustment mechanisms or devices 62 can be used to fill the expanded space with a hardenable liquid. FIG. 9 shows a single fold bellows 140 that can be expanded to the position 140A as the space 126 is filled with grout and the parts 114, 122 move apart. The figure also indicates in phantom lines at 150, the use of a diaphragm which deflects to contain the grout during expansion of the volume. Rods 152 which can slide in holes in the retainer 122, help support the bearing segment.

FIG. 8 shows another deflection limiter 160 that is used in conjunction with an elastomeric body 60M that does not have a large central passage. The limiter 160 is not preferred, because its arms such as 162, 164, 166 are not as thick as the limiter 80 of FIG. 6. A limiter could be used that allows limited movement of both plates 70, 72 relative to the limiter, although it is preferable to substantially fix the limiter with respect to one plate.

FIGS. 10–15 illustrate another lower bearing arrangement 200, with FIG. 10 showing the entire transfer structure 202. The transfer structure includes a turret 204 mounted on the vessel hull 206, for rotation about a primarily vertical axis 208. The lower bearing arrangement 200 can accommodate tilt of the axis as to 208A, about a center of tilt 210. The turret of FIG. 10 has a bearing arrangement 212 of the type described in my earlier U.S. Pat. No. 5,515,804, which allows pivoting of the primarily vertical turret axis about an upper location (at 210) that lies on the axis. It is noted, however, that the present turret is a large diameter turret, whose average outside diameter F and whose diameter F at the lower bearing interface 241 is at least 20% of the hull height J (in FIG. 10 the turret diameter is 40% of the hull height). The lower bearing arrangement 200 elastically resists tilt and distortion of the turret and/or hull, just as the bearing arrangement of FIGS. 1–9 elastically resists it. However, the bearing arrangement 200 is especially useful to avoid jamming when there is high friction at the lower bearing arrangement.

Figure 11:
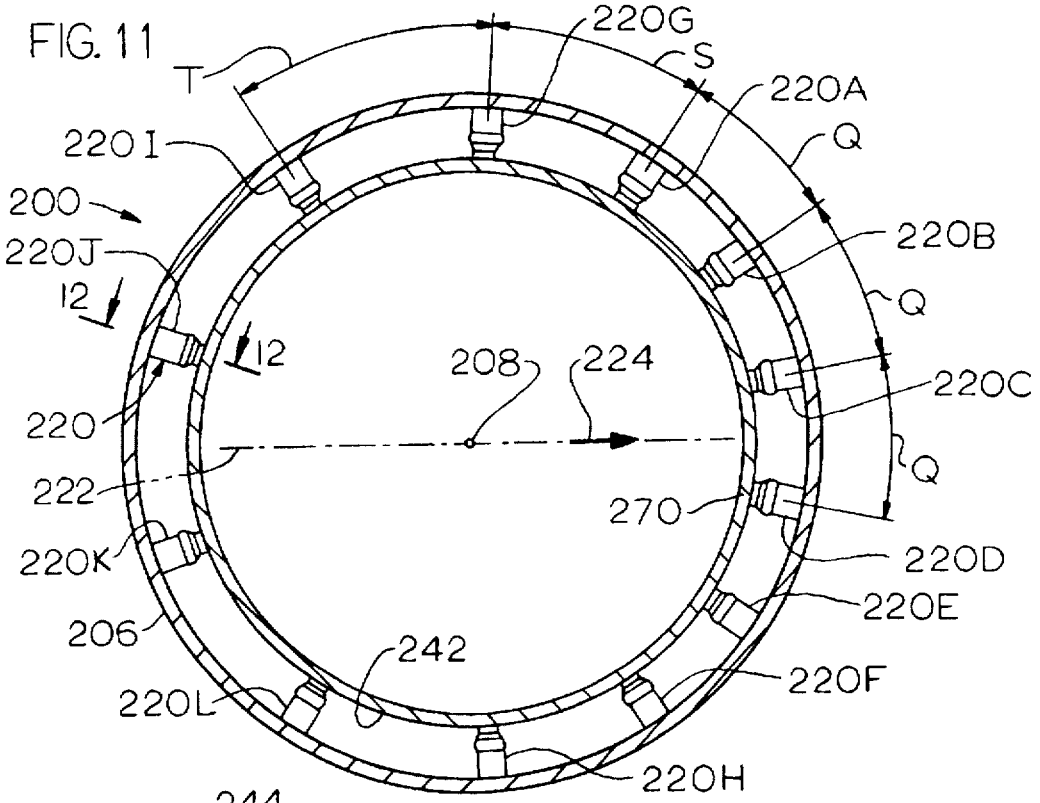
FIG. 11 is a view taken on line 11—11 of FIG. 10.

FIG. 11 shows that the lower bearing arrangement 200 includes twelve segment structures 220 spaced circumferentially about the axis 208 of the turret. The vessel centerline is shown at 222, and the direction to the bow and the usual direction of mooring forces is shown by arrow 224. The segment structures 220 are arranged symmetrically about the centerline 222. The structures 220A–220F lie on a side of the axis 208 that is closest to the bow and usually take the greatest load, these segment structures being closely spaced by angles Q of 22.5°. Segment structures 220G, 220H are spaced from adjacent structures 220A, 220F by a larger angle S of 30°. The other structures 220I–220K are spaced apart by a still larger angle T of 37.5°. The average spacing of structures forward of the axis 208 is about 25°, while the average for structures rearward of the axis is about 37.5°.

Figure 12:
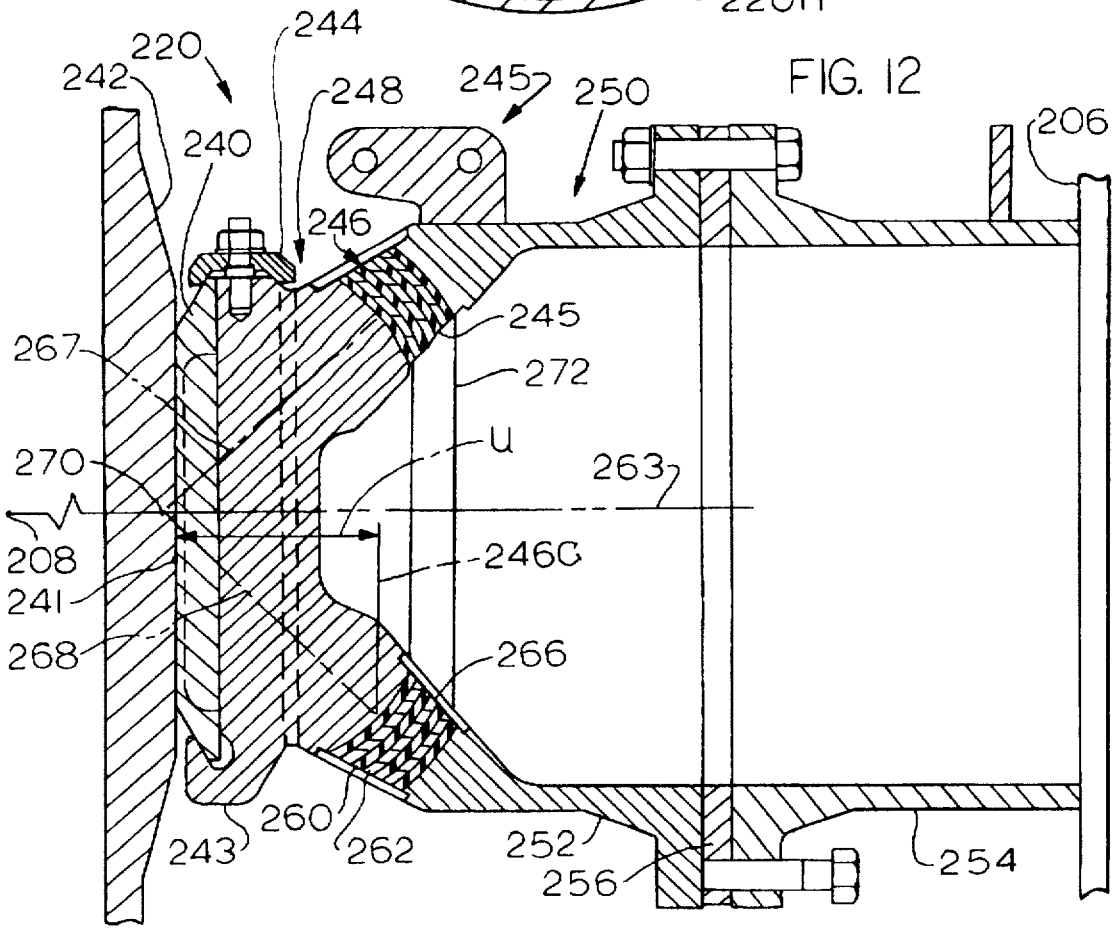
FIG. 12 is a view taken on line 12—12 of FIG. 11.

FIG. 12 shows that each segment structure 220 includes a bronze bearing segment 240 that bears against a continuous bearing ring 242 on the turret, at an interface 241. A base 245 that supports the bearing segment on the vessel hull 206 includes radially inner and outer base elements 248, 250. A resiliently deflectable elastic body 246 lies between the base elements, and is elastically compressible and is elastically deflectable in shear. The inner base element 248 includes a retainer 243, a clamp 244, and the bearing segment 240. The outer base element 250 includes two parts 252, 254 with a shim 256 of proper thickness between them.

Figure 15:
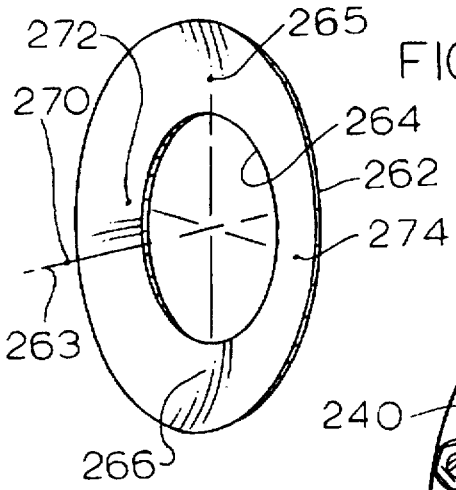
FIG. 15 is an isometric view of an elastomeric sheet of the elastic body of FIG. 12.
Figure 14:
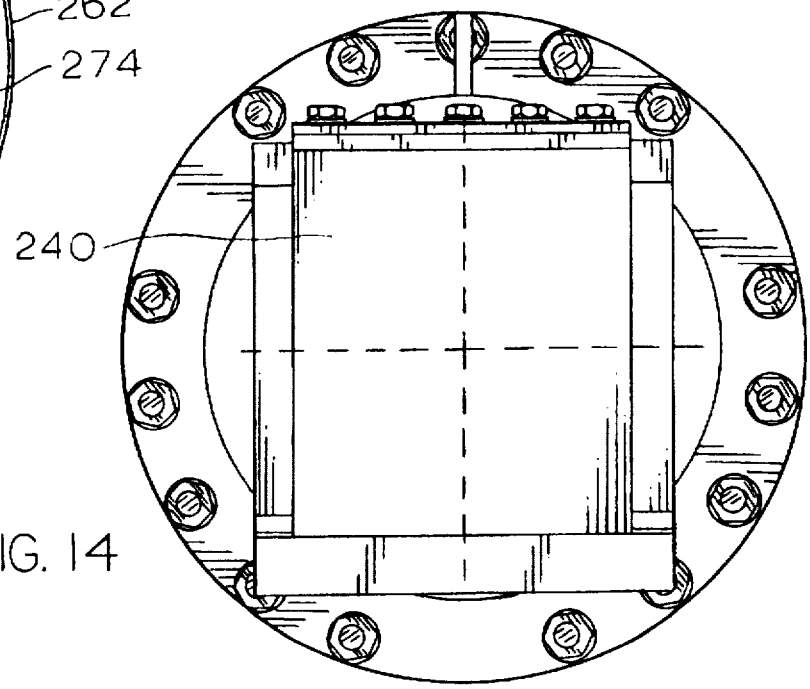
FIG. 14 is a view taken on line 14—14 of FIG. 13.

The elastic body 246 includes a plurality of elastomeric sheets 260 (e.g. rubber) separated by rigid plates 262 (e.g. steel). FIG. 15 shows one of the elastomeric sheets 262, which has a large central hole 264 centered on a horizontal radial line 263, and which is part of a sphere. FIG. 12 shows that the surfaces of the sheets and plates lie on an imaginary sphere having a center, or convergence point 270 that preferably lies at or slightly beyond (radially inward) of the interface 241. The convergence point 270 lies at about the interface, or in other words, the radial distance between the center of the body face at 246C closest to the interface and the convergence point 270, is between 75% and 200% of the distance U between the body face and the interface, or the convergence point 270 (FIG. 11) is closer to the interface 241 than to the axis 208 or to the body face at 246C. Upper and lower portions 265, 266 (FIG. 12) of the body lie respectively above and below the center 270 and respectively face at downward and upward inclines 267, 268 at the center.

Figure 13:
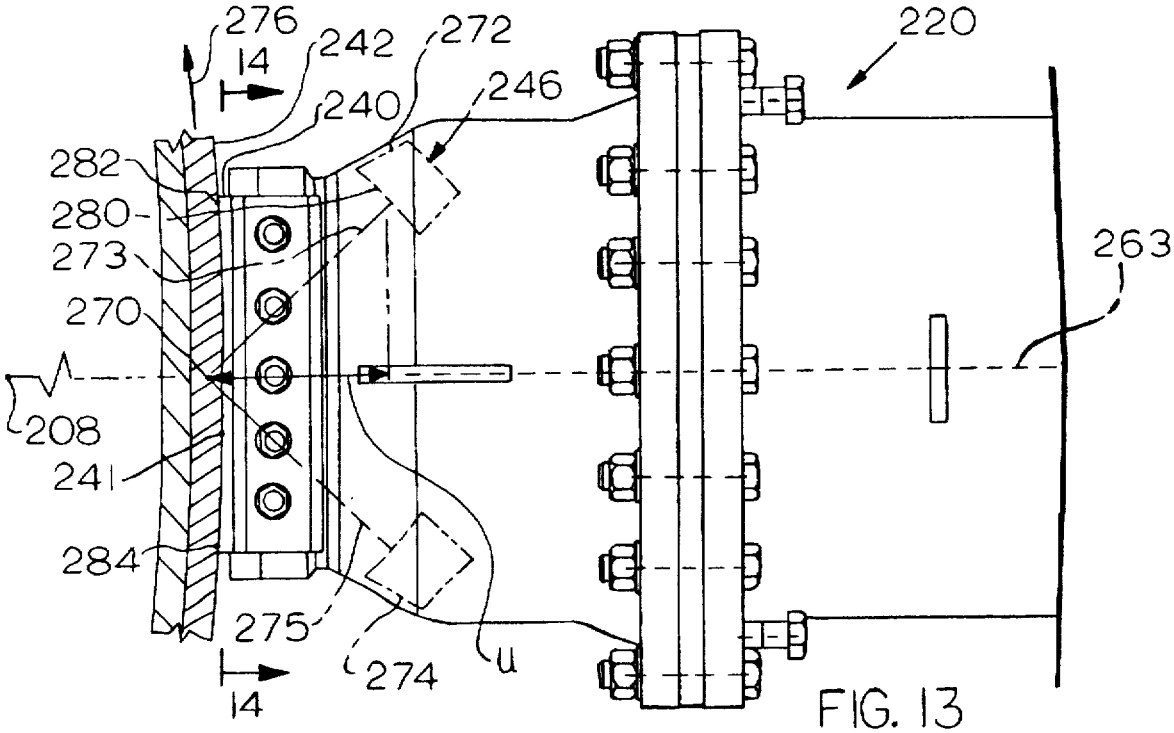
FIG. 13 is a plan view of the segment structure of FIG. 12.

FIG. 13 is a plan view of one segment structure, showing, in phantom lines, horizontally-spaced opposite sides 272, 274 of the elastic body 246 that face along converging lines 273, 275 that converge at the center 270. If the turret bearing ring 242 begins to turn in the direction 276, but there is high friction against the bearing segment 240, then a large force is applied in direction 276 to the trailing side 272 of the radially inner end 280 of the elastic body. Ordinarily, this would cause the leading edge 284 of the bearing segment 240 to "dig in" to the bearing ring 242, resulting in very high friction. However, in the present case, the force in direction 276 on the elastic body tends to cause the elastic body to pivot about the spherical center 270, resulting in the trailing edge 282 of the bearing segment "digging in" (moving radially inward toward the turret axis). Such pivoting about the axis 270 also causes the leading edge 284 of the bearing segment 240, to tend to move away from the bearing ring. This is highly advantageous in preventing a leading edge "digging in" that could cause very high pressures at the leading edge 284.

A digging in of the leading edge 284 would occur if a small elastomeric body were used to support the bearing segment 240, instead of applicant's spherical body which has horizontally spaced opposite sides 272, 274 that face towards the spherical center 270. When applicant's body deflects under the force 276, it pivots about the center point 270. Applicant has calculated and found that it would be possible for the opposite sides 272, 274 of the elastic body to lie on a cone instead of a sphere, although this results in a slight decrease in efficiency in avoiding "digging in."

Applicant's spherical construction which avoids "digging in" of the leading edge, still provides elastic resistance to relative movement of the turret to the hull, as when the turret tilts about its vertical axis or the turret or vessel deforms and one side of the elastic body is compressed. It is noted that the greatest possibility of damage to the elastic body 246 would occur from friction when the turret begins to turn about its axis, and applicant's construction that avoids "digging in" avoids the possibility of large deflection of the elastic body. As a result, applicant is able to avoid the need for a limiter to limit deflection of the elastic body.

Applicant has considered the possibility of providing a spherical body without the hole (264 in FIG. 15). However, calculations show that the additional rubber resulting from eliminating the hole, would result in excess stiffness of the elastic body against compression when the turret tilts.

In a structure of the type shown in FIGS. 11–15 that applicant designed, the diameter of the turret at the interface 241 is 6.81 meters. Each of the segment structures has a radial length (shown in FIG. 12 between the interface 241 and the hull 206) of 0.96 meters, and each of the elastic bodies 246 has a vertical height and circumferential width (which is horizontal) of 0.58 meters. The distance U between the elastic body and interface is 21 centimeters, and the center point 270 is spaced less than 10 centimeters from the interface.

Thus, the invention provides an offshore system with a turret lying within a vessel hull, and provides a bearing assembly with segment structures for controlling the position of a portion of the turret with respect to the hull of the vessel. The system is especially useful for large diameter turrets (a diameter at the lower bearing interface which is at least 4 meters and at least 20% of the average hull height), lying in a moonpool near the middle of the vessel hull, where large stresses are due primarily to vessel and/or turret distortion away from a circular axial cross-section. Each segment structure includes a body of elastomeric material, and each segment structure extends radially between elements of a base. Deflection of the elastomeric body can be limited by a deflection limiter. An adjustment mechanism or device can be used during installation, to move the bearing segment of a segment structure radially substantially against the bearing ring. The adjustment device holds a hardenable liquid such as grout to fix the position of the bearing segment wherein it lies facewise against the bearing ring. The elastic body can have opposite sides that lie largely on an imaginary sphere with a center lying close to the interface between the bearing segment and the continuous bearing ring on the turret.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A vessel which includes a large turret that lies in a moonpool in the middle portion of a vessel hull where the turret is supported in rotation about a primarily vertical axis on the hull by upper and lower bearing assemblies, with the lower bearing assembly having an interface, and with the turret diameter at said interface being at least 20% of the hull height, where said lower bearing assembly includes a bearing ring that is substantially centered on said axis and a plurality of segment structures that include circumferentially-spaced segment bearings that lie facewise adjacent to said bearing ring at said interface, and where the bearing ring and plurality of segment structures are mounted one to a turret part and one to a hull part, wherein:

each of a plurality of said segment structures includes a base with radially spaced inner and outer base elements and a body that comprises elastomeric material lying between the elements and being elastically distortable, with said segment bearings mounted on said inner base elements, and with said segment bearings being free of direct rigid connection to each other to allow each of said segment bearings to individually deflect by deflection of the corresponding elastomeric body, to thereby minimize stresses due to distortion of said hull or turret.

2. A vessel which includes a large turret that lies in a moonpool in the middle portion of a vessel hull where the turret is supported in rotation about a primarily vertical axis on the hull by upper and lower bearing assemblies, with the lower bearing assembly having an interface, and with the turret diameter at said interface being at least 20% of the hull height, where said lower bearing assembly includes a bearing ring that is substantially centered on said axis and a plurality of segment structures that include circumferentially-spaced segment bearings that lie facewise adjacent to said bearing ring at said interface, and where the bearing ring and plurality of segment structures are mounted one to a turret part and one to a hull part, wherein:

each of a plurality of said segment structures includes a base with radially spaced inner and outer base elements and an elastomeric body lying between the elements and being elastically distortable to minimize stresses due to distortion of said hull part;

each of said bodies has circumferentially-spaced opposite sides that face in directions that converge at a convergence point lying closer to said interface than to said turret axis or to said body, with said opposite sides lying on opposite sides of a radial line extending through said turret axis and through said convergence point.

3. A bearing assembly for controlling the position of a turret part with respect to the hull part of a vessel, where the turret part can rotate about a primarily vertical turret axis with respect to the hull part, where the bearing assembly includes a bearing ring that is substantially centered on said axis and a plurality of segment structures that include circumferentially-spaced segment bearings that lie facewise adjacent to said bearing ring at an interface, and where the bearing ring and plurality of segment structures are mounted each to a different one of said parts, wherein:

each of a plurality of said segment structures includes a base with radially spaced inner and outer base elements and a resiliently compressible body lying between the elements;

each of said bodies has circumferentially-spaced opposite sides that face in directions that converge at a convergence point lying closer to said interface than to said turret axis or to said body, with said opposite sides lying on opposite sides of a radial line extending through said turret axis and through said convergence point.

4. The bearing assembly described in claim 3 wherein;

each of said bodies has vertically spaced upper and lower portions that face in directions that converge at a second point located closer to said interface than to said turret axis or said body, with said upper and lower portions lying respectively above and below said second point.

5. The bearing assembly described in claim 3 wherein:

each of said bodies includes a plurality of sheets of elastomeric material separated by plates of rigid material, with each of said sheets and plates having surfaces that lie substantially on an imaginary sphere whose spherical center lie substantially on said interface.

6. The bearing assembly described in claim 3 wherein:

each of said opposite sides of each body is elastically compressible between said inner and outer base elements, and each of said elastic bodies has a space between said opposite sides with said space being devoid of body portions that are elastically compressible between said inner and outer base elements.

7. The bearing assembly described in claim 3 wherein:

said vessel hull has a bow that faces in a forward direction;

said segment structures are arranged with a smaller average circumferential spacing between those lying forward of said turret axis than those lying rearward of said turret axis.

8. A bearing assembly for controlling the position of a turret with respect to the hull of a vessel which has a bow that faces in a forward direction, where the turret can rotate about a primarily vertical axis with respect to the hull, where the bearing assembly includes a substantially continuous bearing ring that is substantially centered on said axis and a plurality of segment structures that include circumferentially-spaced segment bearings, and where the bearing ring and plurality of segment structures are mounted one to said turret and one to said hull, wherein:

said segment structures are arranged with a plurality thereof lying forward of said turret axis and at least one thereof lying rearward of said turret axis, said segment structures being arranged so there is a smaller average angular circumferential spacing between those segment structures that lie forward of said turret than between said at least one segment structure that lies rearward of said turret axis and adjacent ones of said segment structures.

9. A bearing assembly for controlling the position of a turret with respect to the hull of a vessel, where the turret can rotate about a primarily vertical axis with respect to the hull, where the bearing assembly includes a substantially continuous bearing ring that is substantially centered on said axis and a plurality of segment structures that include circumferentially-spaced segment bearings, and where the bearing ring and plurality of segment structures are mounted one to said turret and one to said hull, wherein:

each of plurality of said segment structures includes a base (56) with radially spaced inner and outer elements (66, 64), and elastomeric body (60) extending between the elements, and a deflection limiter (80) extending substantially between the elements;

said deflection limiter having a first end (115) substantially fixed to a first of said elements and having a radially opposite second end (112) that is circumferentially spaced from the second element but which lies in the path of the second element if the second element moves circumferentially relative to the first element by more than a predetermined distance (C) which is more than one millimeter.

10. The assembly described in claim 9 wherein:

said second end of said deflection limiter lies in the path of said second element if said second element moves vertically relative to the first element by more than a second predetermined amount (B), with each of said amounts (B, C) being a plurality of millimeters.

11. The assembly described in claim 9 wherein:

said second end of said deflection limiter is axially spaced by a predetermined distance (A) from said second element which is a plurality of millimeters.

12. The bearing assembly described in claim 9 wherein:

said elastomeric body has a largely radially-extending passage (120), said second element includes a rigid plate with a hole (116), and said deflection limiter includes a rigid member fixed to said first element and projecting through said passage and having a member end lying in said hole, with said hole being larger than said member end to leave a clearance of a plurality of millimeters between them.

13. A bearing assembly for controlling the position of a turret with respect to the hull of a vessel wherein the turret can rotate about a primarily vertical axis with respect to the hull, where the bearing assembly includes a substantially continuous bearing ring that is substantially centered on said axis and a plurality of segment structures that include circumferentially-spaced segment bearings, where the bearing ring and the plurality of segment structures are mounted one to said turret and one to said hull, wherein:

each of a plurality of said segment structures includes a base and an adjustment device with a first adjustment part coupled to the segment bearing thereof and with a second adjustment part coupled to the base thereof and radially movable with respect to said first adjustment part, with a volume enclosed between said adjustment parts which can hold a hardenable liquid to keep said adjustment parts apart after said segment bearing has advanced substantially against said bearing ring.

14. The bearing assembly described in claim 13 including:

a quantity of hardened material lying in said volume and which, prior to hardening can flow at near room temperature and which then hardens.

15. The bearing assembly described in claim 13 wherein:

at least a first of said adjustment parts forms a tube and the second of said adjustment parts forms a piston that is slidable in said tube.

16. The bearing assembly described in claim 13 wherein:

said base comprises inner and outer rigid plate devices and a quantity of elastomeric material lying between said plate devices;

a deflection limiter of rigid material extending radially between said inner and outer rigid plate devices and allowing relative movement of said rigid plate devices but limiting their relative movement.

17. A method for installing each of a plurality of segment support structures of a turret bearing assembly that lies between a hull portion and a turret portion of an offshore vessel system, where the turret bearing assembly includes a substantially continuous bearing ring that is substantially centered on a primarily vertical axis and mounted on a first of said portions, where said plurality of segment structures are circumferentially spaced about said axis, and wherein each of said segment structures includes a bearing segment substantially engaged with said bearing ring, a base mounted on a second of said portions, and an adjustment device that has a pair, of radially spaced adjustment parts, one connected to said bearing ring and the other connected to said base, comprising:

increasing the radial separation of the adjustment parts of a first of said segment structures until the first bearing segment lies substantially against said bearing ring, flowing a quantity of hardenable liquid material between the pair of adjustment parts to fill a space between them with said liquid, and allowing said liquid to harden.

18. The method described in claim 17 including:

coupling opposite ends of each of a plurality of actuators respectively to each of said adjustment parts and energizing said actuators to move said parts radially apart to thereby move said bearing segment away from said base and substantially against said bearing ring, in addition to performing said step of flowing liquid material.

19. The method described in claim 17 including:

placing a shim between said bearing ring and said bearing segment prior to hardening of said liquid material, and removing said shim after substantial hardening of said liquid material.

* * * * *